United States Patent [19]

Newcomb

[11] 4,209,790

[45] Jun. 24, 1980

[54] VERTICAL ANTENNA WITH STUB CANCELLATION MEANS

[75] Inventor: Donald R. Newcomb, Lake Crystal, Minn.

[73] Assignee: Butternut Electronics Co., Lake Crystal, Minn.

[21] Appl. No.: 13,209

[22] Filed: Feb. 21, 1979

[51] Int. Cl.[2] ..... H01Q 9/16

[52] U.S. Cl. ..... 343/830; 343/831; 343/901

[58] Field of Search ..... 343/829, 830, 889, 900, 343/901, 750, 905, 831

[56] References Cited

U.S. PATENT DOCUMENTS

| | | | |
|---|---|---|---|
| 2,425,585 | 8/1947 | Wheeler | 343/830 |
| 3,172,109 | 3/1965 | Senrui | 343/749 |

*Primary Examiner*—David K. Moore

*Attorney, Agent, or Firm*—Hugh D. Jaeger

[57] ABSTRACT

Vertical antenna including a vertical radiator having a height of three-half wavelengths, a cancellation stub electrically connected to the vertical radiator three-quarters wavelength upward from a feed point at the base of the vertical radiator and extending downwardly one-quarter wavelength and upwardly one-half wavelength from the electrical connecting point of the vertical radiator, an insulation member mounted in a mounting post and supporting the base of the vertical radiator, quarter wavelength radials extending outwardly in the same plane and at right angles to the vertical radiator from the mounting post, and a transmission line connected between the feed point at the base of the vertical radiator and the radials. The gain of the vertical antenna is theoretically 3.2 db over a half wavelength dipole antenna. The vertical antenna is particularly lended to operation in the VHF spectrum and above.

11 Claims, 1 Drawing Figure

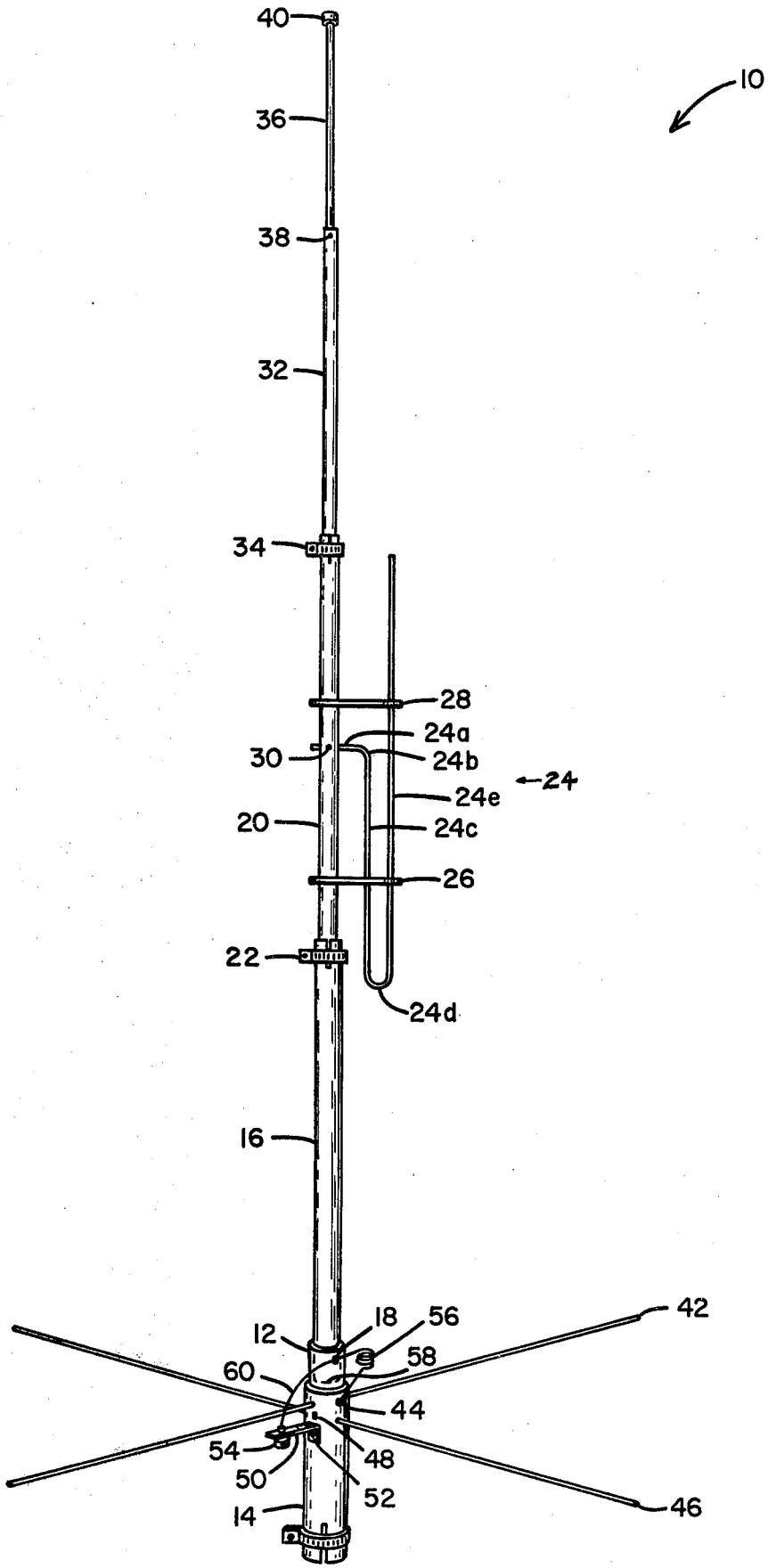
40
10
36
38
32
34
28
24a
30
24b
24
24e
20
24c
26
22
24d
16
42
18
56
12
58
60
44
54
48
50
52
14
46

VERTICAL ANTENNA WITH STUB CANCELLATION MEANS

BACKGROUND OF THE INVENTION

1. Field of the Invention

The present invention relates generally to an antenna, and more particularly, pertains to a vertical antenna.

2. Description of the Prior Art

Those concerned with antennas have long recognized the need for a vertical antenna of manageable physical size yielding a desirable gain. The present invention fullfills this need.

In the field of vertical antennas, especially VHF and UHF antennas, it has been a general practice to utilize phase reversal stubs or self-cancelling coaxial sections making instantaneous current flow take the same direction along the entire vertical radiator or along as much of the radiator as possible. The phase reversal stubs have been unsatisfactory in that the vertical radiator has to be broken with insulating material at or near the inner current antinodes. Since the inner current antinodes are high voltage points, losses are apt to be severe, especially in damp weather and even with the best insulating materials available. Another objection is the weight of the insulators as the phasing reversal stubs have to be self-supporting tubing or rod, or encompassed within self-supporting tubing or rod. A further objection has to do with the additional manufacturing steps involved in manufacturing vertical antennas with the phase reversal stubs including the additional manufacturing expense.

Phase reversal sections can also be quarter wave closed transmission line stubs. The stubs provide that currents in adjacent radiating sections will be in phase with no major or minor high angle lobes. Other phase reversal sections can be in the form of coaxial sections which are mechanically connected to the vertical antenna and results in a system which is electrically and mechanically complicated. A further type of phase reversal section is different lengths of transmission lines interconnecting a number of vertical dipoles together.

One prior art antenna utilizes an extended double zepp section which has been published in a majority of the electrical and antenna handbooks for at least over the last half century. This antenna spaces out the high current points on two five-eighths wavelength collinear radiators in order to approach a gain figure of three collinear half wave elements. The vertical radiator is split in only one place at a low voltage point and a phase reversal stub is utilized which is one-eighth wavelength long. The antenna appears to be an electrical equivalent of a quarter wave stub along where the feed line is tapped for lowest SWR and which is a variation of the old J-match.

The present invention provides a vertical antenna that overcomes all the disadvantages of the prior art vertical antennas and provides a realizable gain which is theoretically greater than comparable vertical antennas.

SUMMARY OF THE INVENTION

The purpose of the present invention is to provide a vertical antenna which exhibits realizable gain over a supportable height of the vertical antenna.

According to one embodiment of the present invention, there is provided a vertical antenna including a vertical radiator having a height of three-half wavelengths, a cancellation stub electrically connected to the vertical radiator three-quarters wavelength upward from a feed point at the base of the vertical radiator and extending vertically downward one-quarter wavelength and vertically upward one-half wavelength from the electrical connecting point of the vertical radiator, an insulation member supporting the base of the vertical radiator, quarter wavelength radials extending outwardly in the same plane and at right angles to the vertical radiator from the insulation member, and a transmission line connected between the feed point at the base of the vertical radiator and the radials.

One significant aspect and feature of the present invention is a vertical antenna of realizable height and having an attractive gain figure. The vertical antenna performs with equal or better gain than other vertical antennas of comparable height and physical size.

Having briefly described an embodiment of the present invention, it is a principal object hereof to provide a vertical antenna for practical operation on frequencies above ten megahertz. Particularly, the vertical antenna is lended in operation to the twenty-seven megahertz Citizens Radio Service Band, fifty megahertz and above including the six meter, and the two meter amateur bands, and UHF and VHF frequencies. The vertical antenna lends itself to utilization by military, commercial, professional, and hobbyists including amateur radio operators.

An object of the present invention is to provide a vertical antenna which provides realizable gain for reasonable height. The vertical antenna of the present invention provides approximately 3.2 db gain over a half wavelength dipole antenna while yet being only three-half wavelengths in vertical height.

Another object of the present invention is to provide a vertical antenna which is physically self-supporting and structurally strong. The vertical antenna of the present invention is a continuous electrical vertical radiator. The electrical vertical radiator is not broken with any insulators or any other coupling paraphernalia such as in the prior art vertical antennas. Also, the cancellation stub electrically affixes and is supported adjacent and substantially parallel to the vertical radiator.

A further object of the present invention is to provide a vertical antenna having a cancellation stub which is electrically connected to the electrical vertical radiator of the vertical antenna, is supported by the electrical vertical radiator, and is substantially parallel to the electrical vertical radiator of the antenna.

An additional object of the present invention is to provide a vertical antenna which is aesthetically pleasing to the eyes of the beholder, of minimal physical structure so as to be unnoticeable and neighborhood compatible. This is especially important in view of new zoning laws by governments regarding placement of antennas. This vertical antenna particularly lends itself to installation in condominiums and other suburban developments where outdoor antennas are usually disallowed as the antenna is of such reasonable height so as to be unnoticeable to the average viewer.

BRIEF DESCRIPTION OF THE DRAWINGS

Other objects and many of the attendant advantages of this invention will be readily appreciated as the same becomes better understood by reference to the following detailed description when considered in connection with the accompanying drawing, in which like reference numerals designate like parts throughout the figure thereof and wherein:

FIG. 1 illustrates a plan view of a vertical antenna, the present invention.

DESCRIPTION OF PREFERRED EMBODIMENTS

FIG. 1, which illustrates a vertical plan view of a vertical antenna, the present invention, shows the electrical vertical radiator consisting of four sections of metal tubing 16, 20, 32, and 36 telescoped and frictionally engaged forming electrical vertical radiator where the bottom first tube 16 is supported by a support center tubular insulator member 12. The center insulator 12 such as fiberglass or TEFLON is supported by a metal tubular support post 14. A first tube 16 telescopes into the tubular center insulator 12 and is secured thereto with a self-tapping sheet metal screw 18. The top of the first tube 16 is slotted as illustrated. A second tube 20 telescopes into the first tube 16 and is secured thereto with a stainless steel compression type hose clamp 22. A cancellation stub 24 including an electrically short horizontal member **24*a*, a right angle curvature bend 24*b*, a quarter wavelength section 24*c*, a 180 degree curvature bend 24*d*, and a half wavelength upwardly extending vertical section 24*e* protrudes through two opposing holes in the second tube 20 not illustrated for purposes of clarity located approximately three-quarters wavelength from the base 58 of the first tube 16 of the vertical antenna 10 and is secured therein by a self-tapping sheet metal screw 30 at an orthogonal angle to the horizontal member 24*a* of the cancellation stub 24. An upper insulating stand-off block 28 having a large and small diameter holes and a lower insulating stand-off block 26 having a large diameter and two small diameter holes and composed of a quarter inch polyethylene strips stand off and insulate the cancellation stub 24 from the second tube 20. The particular placement of the position of the insulator stand-off members 26 and 28 is not critical. The insulating stand-off members 26 and 28 have appropriately sized holes to accommodate the second tube 20 and the diameter of the cancellation stub 24. A third tube 32 telescopes into the slotted end of the second tube 20 and is secured thereto with a small stainless steel compression type hose clamp 34. A fourth tube 36 telescopes into the top of the third tube and is secured thereto with a self-tapping sheet metal screw 38. A suitable cap 40 such as polyethylene secures onto the top of the fourth tube 36 such as by friction engagement for aesthetics and protection from the environmental elements. A plurality of radials, 42 and 46, by way of example and for purposes of illustration only, mounts through the support post 14 in substantially a planar configuration, perpendicular to the vertical radiator, and are affixed thereto with screws 44 and 48. A L-shaped bracket 50 secures to the mounting post 14 with a screw 52 and supports a female coaxial connector 54 such as a SO-239. An impedance matching and dc grounding coil 56 connects between the screw 18 and the screw 44. The center conductor of the coaxial connector 54 connects to the screw 18 with a wire 60 and the outer conductor of the coaxial connector 54 electrically connects through the support post 14 to the plurality of radials 42 and 46. In the alternative, transmission feed line can directly connect between the screws 18 and 44**.

PREFERRED MODE OF OPERATION

The vertical antenna 10 of the present invention is constructed and assembled in one of the following manners. The unslotted end of the first tube 16 is telescoped into the end of the center tubular insulator 12 of the support post 14. A No. 10 screw 18 is passed through the lug not illustrated in the figure from the end of the wire 60 of the coaxial connector 54 and through the aligned holes between the center insulator 12 and the first tube 16. The slotted end of the second tube 20 is passed through the large diameter hole in the lower insulator 26 of the cancellation stub 24 which has already been bent into the shape as illustrated in FIG. 1. The horizontal end **24*a* of the cancellation stub 24 is pushed through the opposing holes in the second tube 20 and secured thereto with the No. 10 screw 30. The upper insulating stand-off member 28 is passed down and over the second tube and the upper portion of the cancellation stub 24*e* and frictionally engages thereto. Physical placement of the insulators 26 and 28 is not critical except for achieving structural support. The cancellation stub 24 is spaced a small fraction of a wavelength such as one-thirtieth wavelength or less from the second tube 20. The third tube 32 is telescoped into the slotted end of the second tube 20 and secured thereto with the compression clamp 34. The fourth tube 36 is slid into the third tube and secured thereto with a No. 6 screw 38. The plurality of radials 42 and 46 are passed through holes just above the coaxial connector 54 supported on the L-bracket 50 and secured thereto with No. 10 screws at right angles thereto. The impedance matching coil 56 connects between the screw 18 and No. 10 screw 44. The vertical antenna 10** can be secured to any suitable mounting mast such as a standard TV mast.

The vertical antenna 10 is fed with suitable transmission line such as fifty ohm coaxial cable transmission feed line.

The exact height of the vertical antenna is determined by the resonating frequency or midband resonance, and lengthening and shortening of the antenna at the two clamps 22 and 32 lowers or raises the resonance frequency respectively. Resonance is determined by checking the VSWR of the vertical antenna.

The vertical antenna 10, while illustrated as being composed of four tubular sections 16, 20, 32, and 36, can be one electrical conductor such as a vertical tower, a vertical electrical rod, or a straight wire. The cancellation stub electrically connects to the tower, rod, or electrical wire, and is suitably supported adjacent thereto.

The vertical antenna 10 lends itself to any frequency of operation. In the lower HF frequencies, the vertical antenna can be a tower. In the higher HF frequencies, the vertical antenna can be a tower or vertical electrical rod. In the frequencies of thirty megahertz and above, the vertical antenna 10 is easily lended to a small self-supporting structure and is particularly lended in operation to the low band six meter, two meter, high band, one and one-quarter meter, and UHF frequencies. The vertical antenna 10 can be particularly used in military applications, commercial applications, professional applications, and amateur radio applications.

By way of example and for purposes of illustration only, the vertical antenna has an overall vertical height of 275.6 cm for two meters, a radial length of 49.4 cm, and the horizontal portion of the cancellation stub connects 107.2 cm from the base of the vertical antenna 10. The four tubular sections 16, 20, 32, and 36 can be 0.75" O.D. ×3' end slotted tube, 0.625" O.D. ×3' end slotted tube, 0.50" O.D. ×2' tube, and 0.375" O.D. ×3' tube. The cancellation stub 24 and radials 42 and 46 can be 3/16" rod. The impedance matching coil can be 4–5 turns of No. 14 wire having a one inch diameter.

The exact lengths of the height of the vertical radiator, the length of the cancellation stub, and the length of the radials are dependent upon the type of material utilized.

Various modifications can be made to the vertical antenna of the present invention without departing from the apparent scope thereof.

Having thus described the invention, what is claimed is:

1. Vertical antenna comprising:

a. vertical radiator means including a height of three half-wavelengths of a resonant operating frequency;

b. cancellation stub means electrically connected to said vertical radiator three-quarters wavelength upward from a feed point at a base of said vertical radiator, said cancellation stub means comprising a first downwardly extending quarter wavelength element, a second upwardly extending half wavelength element parallel to said first element, a U-shaped element connecting said first and second element, said cancellation stub spaced from said vertical radiator by less than one-eigth wavelength;

c. insulation means affixed to said base of said vertical radiator means;

d. plurality of radial means extending a quarter wavelength outwardly below said base of said vertical radiator means and perpendicular to said vertical radiator means; and, e. transmission line means connected between said base of said vertical means and said radial means whereby said vertical radiator is excited with electromagnetic radio frequency currents equal to said resonant frequency of said vertical antenna thereby radiating a vertically polarized radio frequency signal.

2. Vertical antenna comprising:

a. vertical radiator including a height of substantially three half wavelengths of a resonant operating frequency including four sections of metal tubing telescoped into frictional engagement and electrical communication with each of said sections;

b. cancellation stub electrically connected to said vertical radiator substantially three-quarters wavelength from a feed point at a base of said vertical radiator, said cancellation stub comprising a first downwardly extending quarter wavelength element, a second upwardly extending half wavelength element parallel to said first element, a U-shaped element connecting said first and second element, said cancellation stub spaced from said vertical radiator by less than one-eigth wavelength;

c. tubular insulator frictionally engaged over and to said base of said vertical radiator;

d. tubular metal mounting post frictionally engaged over and to said tubular insulator;

e. plurality of at least two radials extending a quarter wavelength outwardly from said tubular mounting post and perpendicular to said vertical radiator; and, f. impedance matching coil electrically connected between said feed point and said plurality of radials whereby a coaxial cable transmission line connects in parallel across said matching coil and excites said vertical antenna with electromagnetic radio frequency currents substantially equal in frequency to said resonant frequency of said vertical antenna thereby radiating a vertically polarized radio frequency signal.

3. The vertical antenna of claim 2 wherein said four sections of tubing are 0.75" O.D. ×3'; 0.625" O.D. ×3'; 0.50" O.D. ×2'; and 0.375" O.D. ×3' for the high band frequencies.

4. The vertical antenna of claim 2 wherein said cancellation stub is 3/16" rod.

5. The vertical antenna of claim 2 wherein said radials are 3/16" rod.

6. The vertical antenna of claim 2 wherein said resonant frequency is fourteen megahertz and above.

7. the vertical antenna of claim 2 wherein said resonant frequency is six meters.

8. The vertical antenna of claim 2 wherein said resonant frequency is two meters.

9. The vertical antenna of claim 8 wherein said height is substantially 108.5 inches.

10. The vertical antenna of claim 9 wherein said impedance matching coil is four to five turns of number fourteen wire on a one-inch diameter.

11. The vertical antenna of claim 10 wherein said cancellation stub is eighteen inches by thirty-eight inches and electrically connected at forty inches from said base of said vertical antenna.

* * * * *